US009306323B2

(12) United States Patent
Kim

(10) Patent No.: US 9,306,323 B2
(45) Date of Patent: Apr. 5, 2016

(54) CABLE CONNECTOR DEVICE

(71) Applicant: Samsung Electronics Co., Ltd., Gyeonggi-do (KR)

(72) Inventor: Ju-Yong Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/921,440

(22) Filed: Oct. 23, 2015

(65) Prior Publication Data

US 2016/0043501 A1 Feb. 11, 2016

Related U.S. Application Data

(63) Continuation of application No. 14/087,099, filed on Nov. 22, 2013, now Pat. No. 9,196,979.

(30) Foreign Application Priority Data

Nov. 26, 2012 (KR) ..... 10-2012-0134484

(51) Int. Cl.
*H01R 11/30* (2006.01)
*H01R 13/62* (2006.01)

(52) U.S. Cl.
CPC ..... *H01R 13/6205* (2013.01)

(58) Field of Classification Search
CPC .... H01R 13/6205; H01R 13/60; H01R 13/24; H01R 13/64; G06F 1/1633; G06F 1/18
USPC ..... 439/39
See application file for complete search history.

(56) References Cited

U.S. PATENT DOCUMENTS

| | | | | |
|---|---|---|---|---|
| 7,204,695 | B1 | 4/2007 | Shiu et al. | |
| 8,011,931 | B2 | 9/2011 | Yin et al. | |
| 2007/0072443 | A1 | 3/2007 | Rohrbach et al. | |
| 2008/0096398 | A1 | 4/2008 | Rohrbach et al. | |
| 2008/0232061 | A1 | 9/2008 | Wang et al. | |
| 2009/0181556 | A1 | 7/2009 | Rohrbach et al. | |
| 2009/0267613 | A1 | 10/2009 | Terlizzi et al. | |
| 2010/0048038 | A1 | 2/2010 | Han et al. | |
| 2010/0089187 | A1 | 4/2010 | Yin et al. | |
| 2010/0191879 | A1* | 7/2010 | Pomerantz ..... | G06F 13/387 710/73 |

(Continued)

FOREIGN PATENT DOCUMENTS

| | | | |
|---|---|---|---|
| CN | 101488620 | A | 7/2009 |
| EP | 2 453 277 | A1 | 5/2012 |

(Continued)

*Primary Examiner* — Jean F Duverne
(74) *Attorney, Agent, or Firm* — Cha & Reiter, LLC

(57) ABSTRACT

A cable connector device for an electronic device is provided. The electronic device includes a connector port disposed in the electronic device, one or more magnet coupling parts, each of the one or more magnet coupling parts which is disposed around the connector port, a cable connector device removably coupled to the connector port, and one or more magnet coupling bodies, each of the one or more magnet coupling bodies which is installed in the cable connector device and has the same polarity as that of each of the one or more magnet coupling parts, wherein each of the one or more magnet coupling parts and each of one or more magnet coupling bodies are disposed in positions where they are pushed by repulsive force when the cable connector device is mounted in a reverse direction.

17 Claims, 7 Drawing Sheets

(56) References Cited

U.S. PATENT DOCUMENTS

| | | | |
|---|---|---|---|
| 2012/0177324 | A1 | 7/2012 | Schwandt et al. |
| 2013/0273752 | A1 | 10/2013 | Rudisill et al. |
| 2014/0087569 | A1 | 3/2014 | Lee |
| 2014/0120746 | A1 | 5/2014 | Persion et al. |
| 2014/0162468 | A1 | 6/2014 | Kim |
| 2014/0285957 | A1 | 9/2014 | Rohrbach et al. |

FOREIGN PATENT DOCUMENTS

| | | | |
|---|---|---|---|
| JP | 2009-205912 | A | 9/2009 |
| KR | 10-2011-0137226 | A | 12/2011 |

* cited by examiner

CABLE CONNECTOR DEVICE

CROSS REFERENCE TO RELATED APPLICATIONS

This is a Continuation application of U.S. patent application Ser. No. 14/087,099 filed on Nov. 22, 2013 which claims the benefit of priority under 35 U.S.C. §119(a) of a Korean patent application filed in the Korean Intellectual Property Office on Nov. 26, 2012 and assigned Serial No. 10-2012-0134484, the entire disclosure of which is hereby incorporated by reference.

BACKGROUND

1. Technical Field

The present disclosure relates to a cable connector device for an electronic device.

2. Description of the Related Art

Recently, as electronic devices have been developed, they have been adapted to cover a variety of fields which are at the heart of modern lives. These electronic devices have been produced in various sizes according to their functions and preference of users. Manufacturers of the electronic devices are concerned about aesthetics as well as functions and slimness of their electronic devices. Although the electronic devices of the manufacturers have the same function as those of other manufacturers generally, electronic devices having more beautiful design are a more preferred by users.

The above-described electronic devices are on a trend of being changed toward maximizing portability. For this reason, it is important to manufacture a cable connector device which charges a battery pack mounted on or in the electronic device or interwork with an external device (e.g., a Personal Computer, etc.) and transmits and receives data.

In general, this cable connector device is formed as a corresponding shape to be inserted into a connector port of the electronic device. For example, there are cable connector devices of various connection types, such as a 5-pin micro cable connector, a 10-pin cable connector, and a 24-pin cable connector.

A connector port in which insertion grooves are commonly formed is installed in a conventional electronic device such that it is mounted on a board of the conventional electronic device and a part of it is exposed to the outside. The cable connector device often connects to the conventional electronic device electrically, and charges the battery pack and/or transmits and receives data by inserting a connector installed at its one end into this insertion groove.

However, the cable connector device inserted into the conventional electronic device is not easily connected to the conventional electronic device which is gradually miniaturized and is thin and light. A connector connection portion of the cable connector device is damaged by certain impact from the outside or the connector port of the conventional electronic device is damaged by severe impact from the outside. Accordingly, because the damaged components must be replaced, they impose an economic burden on the user.

SUMMARY

An aspect of the present disclosure is to solve at least the above-mentioned problems and/or disadvantages and to provide at least the advantages described below. Accordingly, an aspect of the present invention is to provide a cable connector device to be implemented to prevent reverse insertion.

Another aspect is to provide a cable connector device to be implemented to have the same insertion structure without changing a mechanical exterior appearance and prevent reverse insertion.

Another aspect is to provide a cable connector device to be implemented to prevent accidents by selectively removing magnetic force and preventing a short circuit by external metal materials.

In accordance with an aspect of the present disclosure, an electronic device is provided. The electronic device includes a connector port, one or more magnet coupling parts each having the same polarity, a cable connector device configured to be removably coupled to the connector port and having and one or more magnet coupling bodies, each of the one or more magnet coupling bodies which is installed in the cable connector device and has the same polarity as that of each of the one or more magnet coupling parts, wherein each of the one or more magnet coupling parts and each of one or more magnet coupling bodies are positioned such that they are pushed by repulsive force when the cable connector device is mounted in the connector port in a reverse configuration.

In accordance with another aspect, a cable connector device is provided. The cable connector device includes a cable having a length, an external device coupling connector located at one end of the cable and configured to be coupled to an external device, and a pogo connector located at the other end of the cable and configured to be coupled to an electronic device, and one or more magnet coupling bodies, each of the one or more magnet coupling bodies which is disposed around the pogo connector, wherein each of the one or more magnet coupling bodies is disposed in a position where it is capable of being repulsed by a corresponding magnet coupling part of the same polarity which is disposed in the electronic device when the cable connector device is mounted in a reverse direction.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

DETAILED DESCRIPTION

Exemplary embodiments of the present invention will be described herein below with reference to the accompanying drawings. In the following description, well-known functions or constructions are not described in detail since they would obscure the invention in unnecessary detail.

In describing one embodiment of the present invention, a mobile terminal will be shown as an electronic device. A description will be given for a cable connector device which is applied to, but is not limited to this mobile terminal. Accordingly, the cable connector may be applied to or utilized with various devices such as a portable electronic device, a portable terminal, a mobile pad, a media player, a tablet computer, a handheld computer, and a Personal Digital Assistant (PDA). Also, the cable connector device may also be applied to or utilized with various fixed type electronic devices such as a Personal Computer (PC) as well as these portable electronic devices. However, it is to be understood that the present invention is not limited to any one or any group of electronic devices, as the invention is applicable irrespective of the function of the electronic device.

Figure 1:
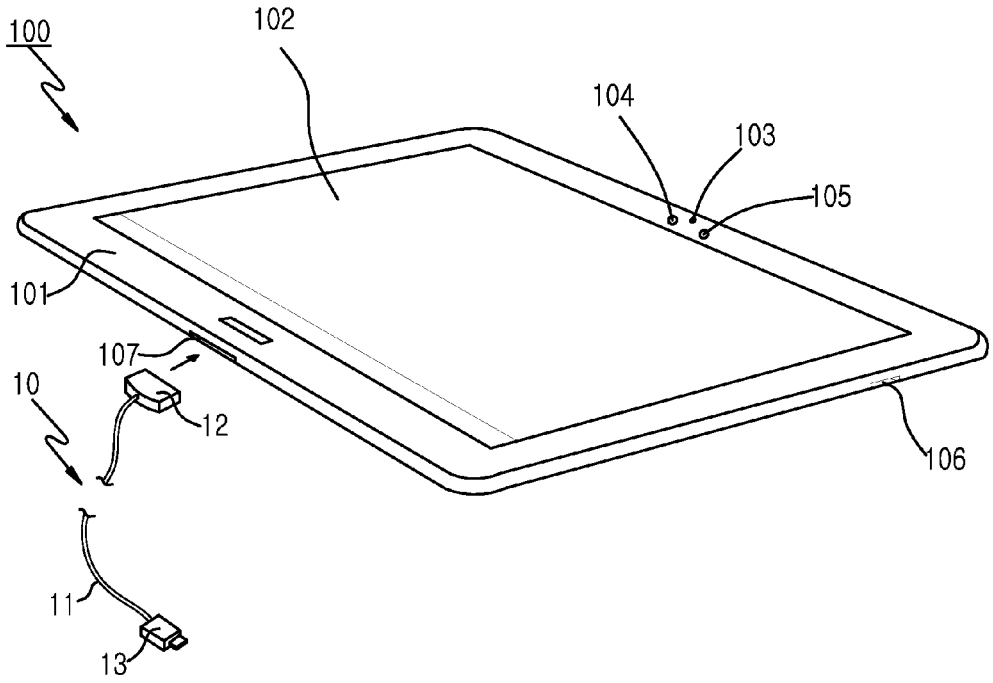
FIG. 1 is a perspective view of an electronic device to which a cable connector device is applied according to one embodiment of the present invention.

FIG. 1 is a perspective view of an electronic device to which a cable connector device is applied according to one embodiment of the present invention.

FIG. 1 shows a tablet-type mobile terminal as the electronic device.

Referring to FIG. 1, a display device 102 is installed on a front surface 101 of the electronic device 100. A microphone device 103 and a plurality of sensors may be installed in an upper portion of the electronic device 100. The plurality of sensors may be a camera 104, an illumination sensor 105, etc. Also, speaker modules 106 can installed at one or both sides of the electronic device 100 to output voices and music when multimedia objects are reproduced.

A connector port to which a cable connector device 10 according to one embodiment of the present invention is applied is typically positioned at a lower side of the electronic device 100. However, connector port 107 may be positioned at any position of the electronic device 100.

In accordance with one embodiment of the present invention, the cable connector device 10 includes a cable 11 of a certain length, a connector 12 which is installed at one end of the cable 11 and is electrically connected with the connector port 107 of the electronic device 100 by a contact type, and an external device coupling connector 13 which is installed at the other end of the cable 11 and is connected to a power source and an external device. In a preferred embodiment, the connector 12 is a pogo connector as is known in the art, containing a plurality of pogo pins, such as those available from Everett Charles Technologies of Pomona, Calif. The external device coupling connector 13 may be a Universal Serial Bus (USB) terminal for being electrically connected with a separate adaptor connected to an external power source.

In accordance with one embodiment of the present invention, when the pogo connector 12 contacts with the connector port 107 of the electronic device 100 in a forward direction, if it is adjacent to the connector port 107 of the electronic device 100, the pogo connector 12 and the connector port 107 are naturally and electrically connected to each other by an attraction force resulting from a magnet installed in the pogo connector 12. However, if the pogo connector 12 will come in contact with the connector port 107 of the electronic device 100 in a reverse direction, connection of the pogo connector 12 the connector port 107 is hindered or even prevented by a repulsive force of the magnet.

The above-described contents will be described in detail below.

Figure 2:
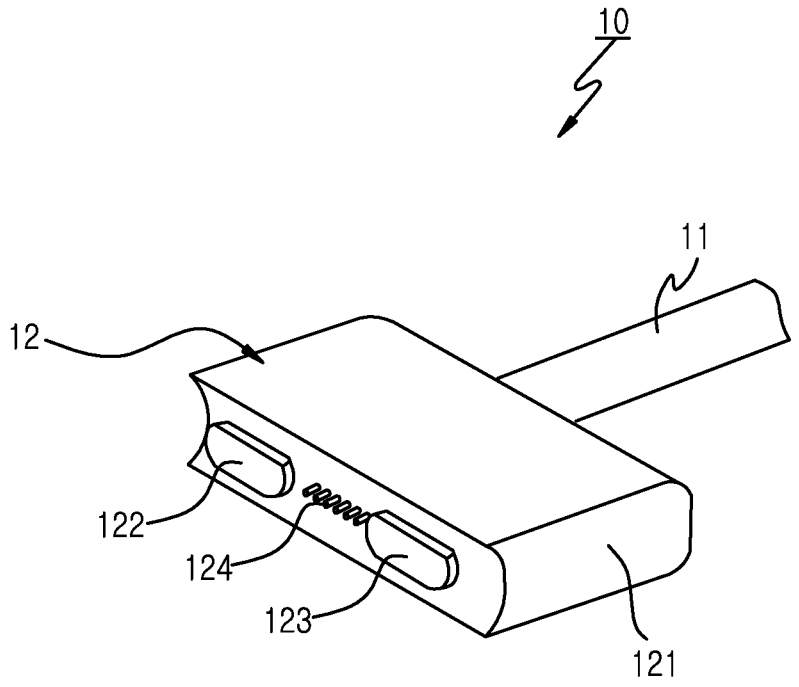
FIG. 2 is a perspective view of an important portion of an electronic device of FIG. 1 according to one embodiment of the present invention.

FIG. 2 is a perspective view of an important portion of an electronic device of FIG. 1 according to one embodiment of the present invention.

Referring to FIG. 2, the pogo connector 12 of the cable connector device 10 includes a body 121, a plurality of pogo pins 124 which are protruded from the body 121 and are installed at regular intervals, a magnet coupling body 122 of a certain shape which is protruded and installed on one end of the pogo pins 124, and a metal coupling body 123 of a certain shape which is protruded and installed on the other end of the pogo pins 124. Preferably, each of the magnet coupling body 122 and metal coupling body 123 are substantially rectangular in shape with rounded off edges, but can be of any shape having horizontal symmetry. Additionally, it is preferred that each of the magnet coupling body and metal coupling body are positioned on opposite sides of the pogo pins.

The magnet coupling body 122 may have any one of an N-pole and an S-pole. The metal coupling body 123 may be formed of pure iron, Special Use Steel (SUS), or any other material which can be influenced by magnetic force of a magnet. Also, it is preferable that the magnet coupling body 122 and the metal coupling body 123 are formed as the same shape.

The pogo pins 124 are typically 6 pins which are protruded and installed at regular intervals. The pogo pins 124 are in a state where it is pressed to the outside or biased outward by an internal elastic body thereof. The pogo pins 124 come in contact with terminals 1074 (see, FIG. 3) located in the connector port 107 of the electronic device while being inserted into the terminals 1074. Accordingly, although the pogo connector 12 is slightly swung or moved, smooth contact with the terminals 1074 of the connector port 107 may be always maintained by the above-described structure of the pogo pins 124. These pogo pins 124 may be, for example, a terminal for transmitting and receiving data, a power supply terminal, and a ground terminal. In addition, the pogo pins 124 shown in FIG. 2 include, but are not limited to, 6 pins.

Figure 4:
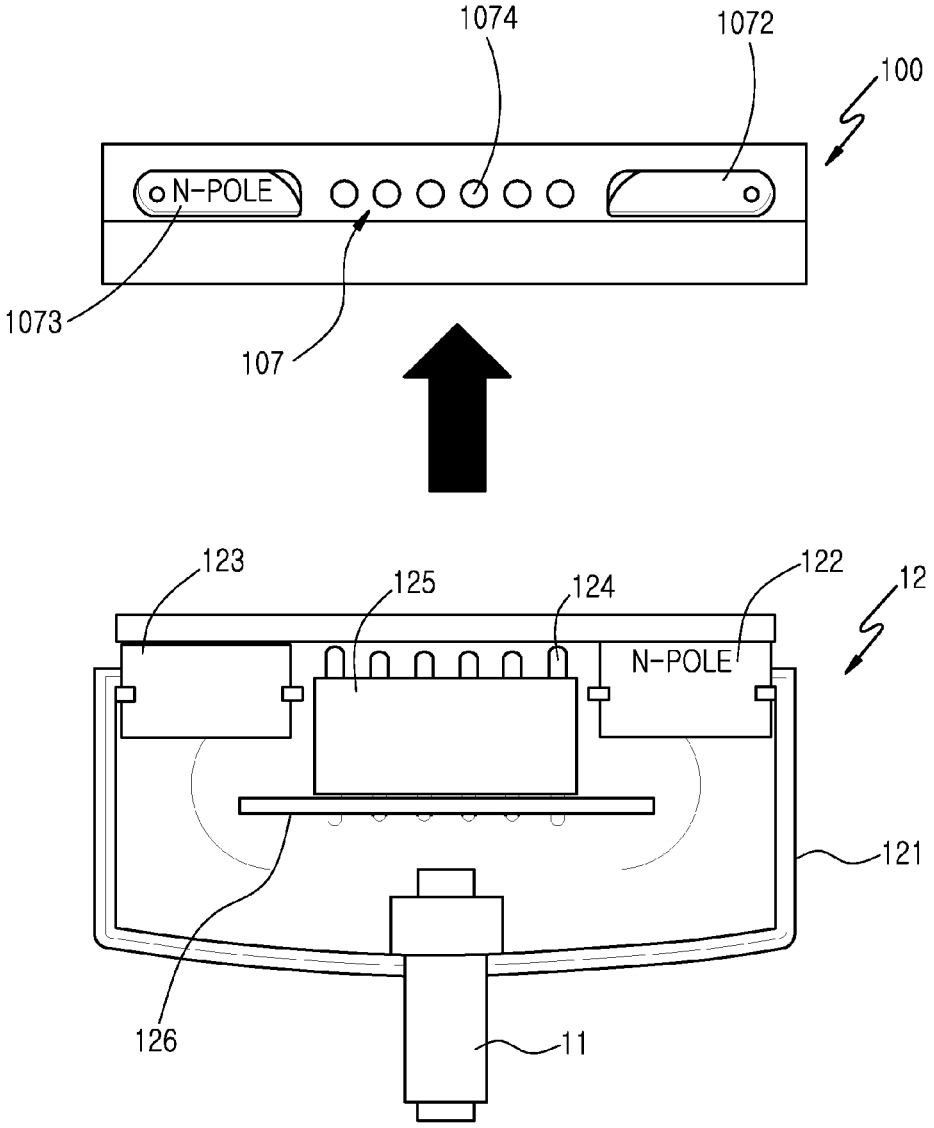
FIG. 4 and FIG. 5 illustrate a process of coupling a cable connector device of FIG. 1 to an electronic device according to one embodiment of the present invention.
Figure 5:
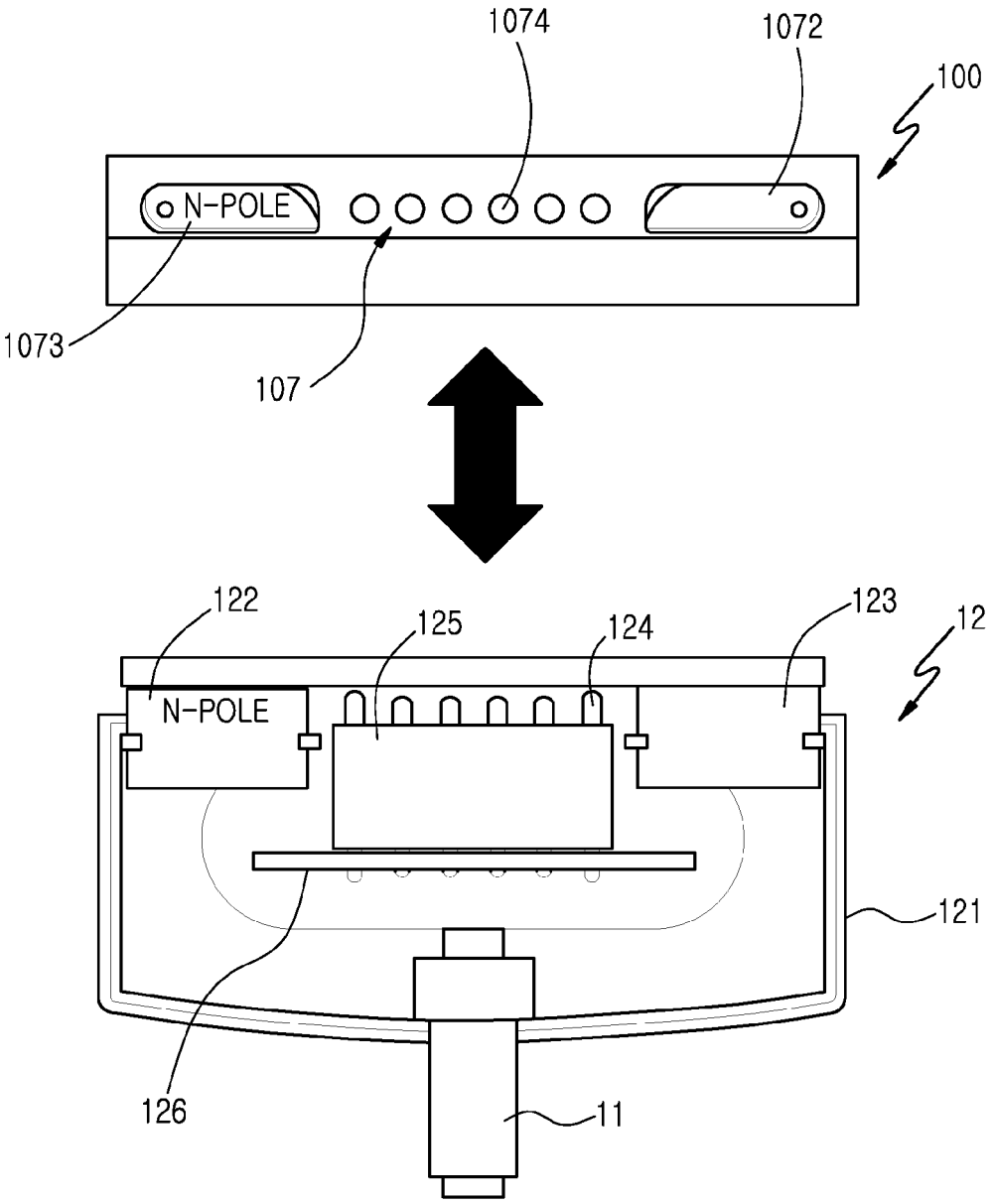

As shown in FIGS. 4 and 5, the pogo pins 124 are located in the pogo connector 12. The pogo pins 124 are positioned in a pogo pin unit 125 which is mounted on a board 126 which is electrically connected with the cable 11. A part of the pogo pins 124 protrudes from the body 121 of the pogo connector 12.

Figure 3:
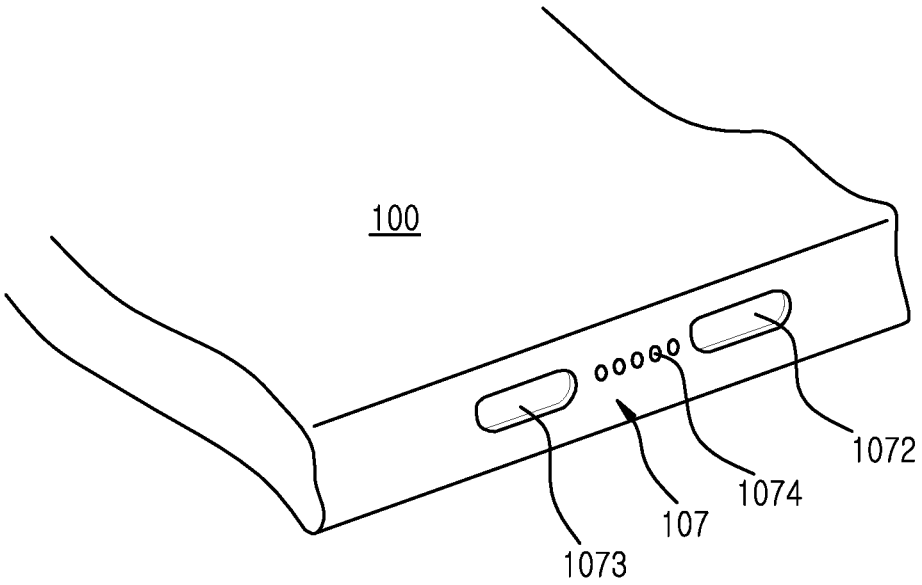
FIG. 3 is a perspective view of an important portion showing a connector port portion of an electronic device of FIG. 1 according to one embodiment of the present invention.

FIG. 3 is a perspective view of a connector port portion of an electronic device of FIG. 1 according to one embodiment of the present invention.

Referring to FIGS. 1 to 3, terminals 1074 are located in positions corresponding to those of the pogo pins 124 of the pogo connector 12, in the connector port 107 of the electronic device 100. These terminals 1074 are exposed to the outside. A metal coupling part 1072 is installed at one end of the terminals 1074 to be attached to the magnet coupling body 122 of the pogo connector 12 by magnetic force of the magnet coupling body 122 of the pogo connector 12. A magnet coupling part 1073 is installed at the other end of the terminals 1074 to be attached to the metal coupling body 123 of the pogo connector 12. The metal coupling part 1072 and the magnet coupling part 1073 are formed as the same shape. It is preferable that the metal coupling part 1072 and the magnet coupling part 1073 are formed as a receiving recess shape of a certain depth to receive a part of the magnet coupling body 122 and a part of the metal coupling body 123, respectively. Because the metal coupling part 1072 and the magnet coupling part 1073 are formed as the same shape, although they are arranged to be exposed to the outside of the electronic device 100, they may help to implement an aesthetic exterior appearance according to bilateral symmetry.

On the other hand, a magnet of the magnet coupling part 1073 is positioned to have any one of an N-pole and an S-pole. Preferably, the magnet coupling part 1073 is configured to have the same polarity as that of the magnet coupling body 122 installed in the above-described pogo connector 12.

More preferably, the metal coupling part 1072 and the magnet coupling body 122 are located in a direction where they contact when the pogo connector 12 is inserted into the connector port 107 of the electronic device 100 in a forward direction. More particularly, the metal coupling part 1072 and the magnet coupling body 122 are disposed such that the magnet coupling body 122 of the pogo connector 12 comes in contact with the metal coupling part 1072 of the connector port 107 and the metal coupling body 123 of the pogo connector 12 comes in contact with the magnet coupling part 1073 of the connector port 107 when the pogo connector 12 is inserted into the connector port 107 of the electronic device 100 in a forward or proper direction. Accordingly, if the pogo connector 12 comes in contact with the connector port 107 in a reverse or "upside down" direction, the magnet coupling body 122 of the pogo connector 12 and the magnet coupling part 1073 of the connector port 107 must be configured to be faced with each other.

FIGS. 4 and 5 illustrate a process of coupling a cable connector device of FIG. 1 to an electronic device according to one embodiment of the present invention.

A description will be given for a process of connecting the cable connector device 10 to the electronic device 100.

Initially, referring to FIGS. 1 and 4, if the pogo connector 12 is brought near to the connector port 107 of the electronic device 100 in a forward direction, the magnet coupling body 122 of the pogo connector 12 is faced with the metal coupling part 1072 of the connector port 107. Simultaneously, the metal coupling body 123 of the pogo connector 12 is faced with the magnet coupling part 1073 of the connector port 107. That is, because the magnet coupling part 1073 and the magnet coupling body 122 are disposed as a structure in which they are opposite each other, the pogo connector 12 comes in contact with the connector port 107 naturally by providing gravity to the metal coupling body 123 and the metal coupling part 1072 by magnetic force of the magnet coupling part 1073 and the magnet coupling body 122. Accordingly, the plurality of pogo pins 124 protruded on the pogo connector 12 come in contact with the plurality of terminals 1074 exposed on the connector port 107 to perform a corresponding function.

On the other hand, as shown in FIG. 5, if the pogo connector 12 is brought near to the connector port 107 of the electronic device 100 in a reverse direction, the magnet coupling body 122 of the pogo connector 12 is faced with the magnet coupling part 1073 of the connector port 107. Simultaneously, the metal coupling body 123 of the pogo connector 12 is faced with the metal coupling part 1072 of the connector port 107. That is, the magnet coupling part 1073 is faced each other with the magnet coupling body 122. Accordingly, repulsive force is generated between the magnet coupling part 1073 and the magnet coupling body 122, having the same polarity. The pogo connector 12 is prohibited from contacting with the connector port 107 by this repulsive force.

In one embodiment of the present invention, the connector port 107 and the pogo connector 12 have the one magnet coupling part 1073 and the one magnet coupling body 122 in a cross direction, respectively. More particularly, in this embodiment, the metal coupling part 1072 and the metal coupling body 123 are eliminated. For example, in a structure where the pogo connector 12 is inserted into the connector port 107 in the forward direction, a plurality of magnets with different polarity may be alternately installed in the pogo connector 12. Also, magnets or metal bodies to which gravity is provided may be installed in positions corresponding to those of the plurality of magnets in the connector port 107. If the plurality of magnets are installed at regular intervals in the connector port 107, the magnets which have the same polarity as those of the corresponding magnets are installed in the pogo connector 12. If the pogo connector 12 is inserted into the connector port 107 in the reverse direction, the pogo pins 124 may be prevented from contacting the terminals 107 incorrectly by providing repulsive force to the pogo connector 12 and the connector port 107.

Figure 6:
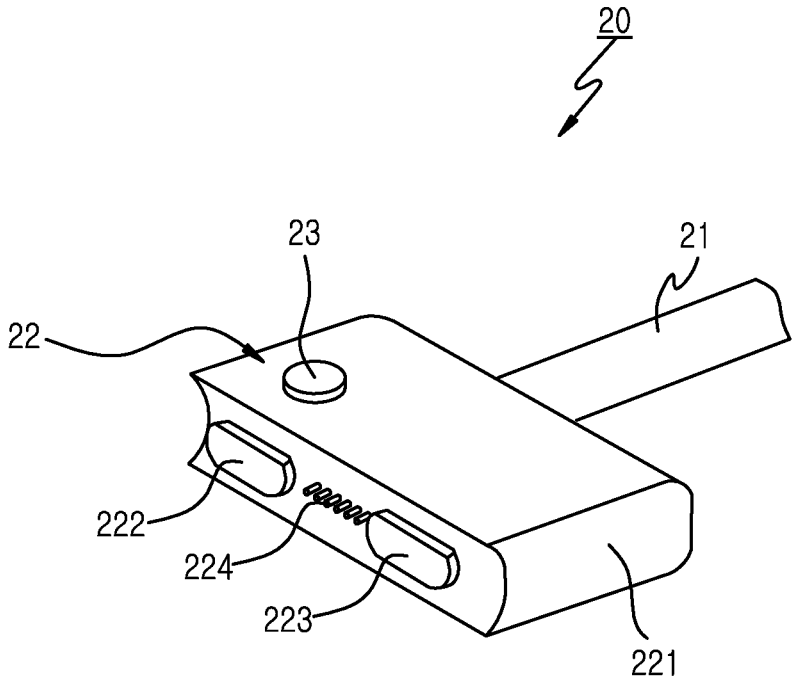
FIG. 6 is a perspective view of an important portion of a cable connector device according to another embodiment of the present invention.
Figure 7:
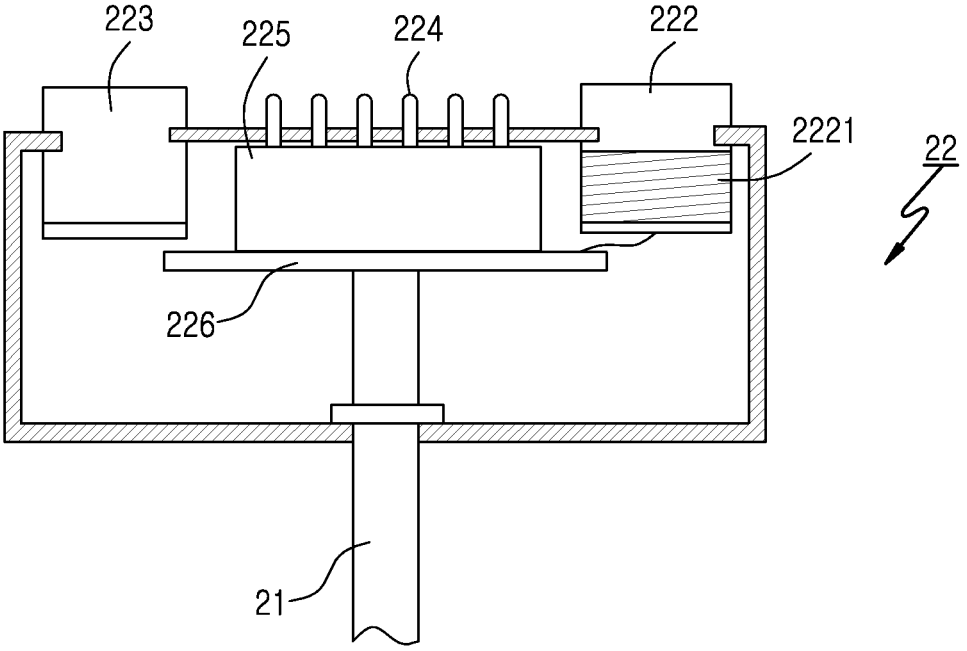
FIG. 7 illustrates an internal structure of a cable connector device of FIG. 6 according to another embodiment of the present invention.

FIG. 6 is a perspective view of an important portion of a cable connector device according to another embodiment of the present invention. FIG. 7 illustrates an internal structure of a cable connector device of FIG. 6 according to another embodiment of the present invention.

All parts of the connector port in these drawings are substantially the same as those in FIGS. 1 to 5. Therefore, the same parts are designated by the same reference and a description thereof will thus be omitted.

Referring to FIGS. 6 and 7, a pogo connector 22 installed at one end of a cable 21 of a cable connector device 20 includes a body 221, a plurality of pogo pins 224 which are protruded from the body 221 and are installed at regular intervals, an electromagnet coupling body 222 of a certain shape which is protruded and installed on one end of the pogo pins 224, and a metal coupling body 223 of a certain shape which are protruded and installed on the other end of the pogo pins 224.

The electromagnet coupling body 222 may have any one of an N-pole and an S-pole when power is supplied thereto. The metal coupling body 223 may be formed of pure iron, SUS, or any material which may be influenced by magnetic force of magnets. Also, it is preferable that the electromagnet coupling body 222 and the metal coupling body 223 are formed as the same shape. More preferably, the electromagnet coupling body 223 should have the same polarity as that of the magnet coupling part 1073 installed in the connector port 107 of the electronic device 100.

The above-described electromagnet coupling body 222 is preferably electrically connected to a board 226 installed in the body 221 of the pogo connector 22 and includes a coil 2221 which is wound many times on a metal body. This coil 2221 may be determined as an S-pole or an N-pole when power is supplied thereto according to a wound direction of the coil 2221 by Faraday's law.

Also, in accordance with another embodiment of the present invention, a magnetic force removal button 23 is installed in the body 221 of the pogo connector 22. Accordingly, when the cable connector device 20 is connected to a power source and is not connected to the electronic device 100, the magnetic force removal button 23 prevents the pogo pin 224 of the pogo connector 22 from being obstructed because peripheral metal materials (e.g., clips, staples, etc.) are attracted to the pogo pins 224. The magnetic force removal button 23 prevents inconvenience in which a user of the electronic device 100 must remove these metal materials separately.

Also, if the user swings the pogo connector 22 in a state where he or she pushes the magnetic force removal button 23 of the body 221 which is protruded on the body 221, any metal materials attached by magnetic force may be easily separated because magnetic force is removed. The above-described magnetic force removal button 23 may be any one of, for example, a well-known contact switch for blocking power supplied to the coil 2221.

The cable connector device according to embodiments of the present invention may prevent the pogo connector from being inserted into the connector port in the reverse direction although the connector port and the pogo connector have the mechanical same insertion structure. The cable connector device may be configured to design the exterior appearance of the electronic device beautifully. The cable connector device may prevent a short circuit phenomenon by external metal materials by selectively removing magnetic force.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A connector being capable of coupling to a connector port of an electronic device, comprising:

at least one connector pin disposed on a coupling face of the connector; and at least one magnet coupling body disposed on the coupling face of the connector, and spaced apart from the connector pin, wherein the at least one magnet coupling body is positioned such that the magnet coupling body pushes a magnet coupling part disposed on a coupling face of the connector port of the electronic device by a repulsive force when the connector is mounted in the connector port in a reverse configuration, thereby inhibiting connection of the connector port and the connector to one another.

2. The connector of claim 1, wherein the connector further comprises:

a cable having a length; and an external device coupling connector installed at one end of the cable and configured to be coupled to an external device.

3. The connector of claim 1, wherein the connector further comprises:

at least one pogo pin positioned corresponding to that of one or more terminals in the electronic device; and at least one metal coupling body installed in a position corresponding to the magnet coupling parts of the connector port, the metal coupling body comprising a material capable of being influenced by a magnetic force.

4. The connector of claim 3, wherein the magnet coupling body and the metal coupling body are formed as a protruded shape, wherein the magnet coupling part and the metal coupling part are formed as a receiving recess shape in which at least the one metal coupling body and the magnet coupling body are configured to be received, and wherein the magnet coupling part and the metal coupling part are configured to have the same shape.

5. The connector of claim 3, wherein the metal coupling body is disposed at one end of the connector centering around at least the one pogo pin, the at least one magnet coupling body is disposed at the other end of the connector centering around at least the one pogo pin, and the metal coupling body and magnet coupling body are disposed to have bilateral symmetry.

6. The connector of claim 1, wherein the at least one magnet coupling body comprises a coil wrapped a plurality of times about a metal body, such that the magnet coupling body can function as an electromagnet when power is supplied to the coil.

7. The connector claim 6, further comprising a magnet force removal button, allocated in the connector, the magnet force removal button configured to selectively block power supplied to the coil.

8. The connector of claim 7, wherein the power supplied to the coil is blocked only when the magnetic force removal button is pushed.

9. The connector of claim 1, wherein the magnet coupling part and the magnet coupling body are magnets having the same polarity.

10. An electronic device being capable of coupling to a connector comprising:

a connector port, disposed in the electronic device, being detachably coupling to a connector, comprising;

at least one connector terminal disposed on a coupling face of the connector port; and at least one magnet coupling part disposed on the coupling face of the connector port, and spaced apart from the connector terminal, wherein the at least one magnet coupling part is positioned such that the magnet coupling part pushes a magnet coupling body disposed on a coupling face of the connector by a repulsive force when the connector is mounted in the connector port in a reverse configuration, thereby inhibiting connection of the connector port and the connector to one another.

11. The electronic device of claim 10, wherein the connector port further comprises:

at least one terminal disposed on the electronic device, wherein a portion of each terminal is exposed; and at least one metal coupling part, the metal coupling part positioned in proximity to the terminals and comprising a material capable of being influenced by a magnetic force.

12. The electronic device of claim 11, wherein the magnet coupling part is disposed at one end of the connector port centering around the at least one terminal, the metal coupling part is disposed at the other end of the connector port centering around the one or more terminals, and each of the magnet coupling parts and each of the metal coupling parts are disposed to have bilateral symmetry.

13. A system comprising:

an electronic device including a connector port, the connector port comprising at least one magnet coupling part; and a connector configured to be detachably coupled to the connector port, the connector comprising at least one magnet coupling body, wherein a magnet coupling part of the connector port and a magnet coupling body of the connector are positioned such that the magnet coupling part and the magnet coupling body are pushed to one another by repulsive force when the connector is mounted in the connector port in a reverse configuration, thereby inhibiting connection of the connector port and the connector to one another.

14. The system of claim 13, wherein the connector further comprises:

at least one pogo pin positioned corresponding to that of one or more terminals in the electronic device; and at least one metal coupling body installed in a position corresponding to the magnet coupling parts of the connector port, the metal coupling body comprising a material capable of being influenced by a magnetic force.

15. The system of claim 14, wherein the connector port further comprises:

at least one terminal disposed on the electronic device, wherein a portion of each terminal is exposed; and at least one metal coupling part, the metal coupling part positioned in proximity to the terminals and comprising a material capable of being influenced by a magnetic force.

16. The electrical connection system of claim 15, wherein the magnet coupling body and the metal coupling body are formed as a protruded shape, wherein the magnet coupling part and the metal coupling part are formed as a receiving recess shape in which at least the one metal coupling body and the magnet coupling body are configured to be received, and wherein the magnet coupling part and the metal coupling part are configured to have the same shape.

17. The system of claim 13, wherein the magnet coupling part and the magnet coupling body are magnets having the same polarity.

* * * * *